US009656786B2

(12) United States Patent
Seki et al.

(10) Patent No.: US 9,656,786 B2
(45) Date of Patent: May 23, 2017

(54) PLUG

(71) Applicant: TOPPAN PRINTING CO., LTD., Tokyo (JP)

(72) Inventors: Takekuni Seki, Tokyo (JP); Kiyoshi Wada, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/367,652

(22) PCT Filed: Dec. 18, 2012

(86) PCT No.: PCT/JP2012/082811

§ 371 (c)(1),
(2) Date: Jun. 20, 2014

(87) PCT Pub. No.: WO2013/094611

PCT Pub. Date: Jun. 27, 2013

(65) Prior Publication Data

US 2014/0332492 A1 Nov. 13, 2014

(30) Foreign Application Priority Data

Dec. 22, 2011 (JP) ..... 2011-281428

(51) Int. Cl.
*A61J 1/00* (2006.01)
*B65D 51/20* (2006.01)
(Continued)

(52) U.S. Cl.
CPC ..... *B65D 51/20* (2013.01); *B41J 2/17523* (2013.01); *B65D 51/002* (2013.01);
(Continued)

(58) Field of Classification Search
CPC ..... A61J 1/10; A61J 1/1406; A61J 1/1475; B65D 83/40; B65D 51/20; B65D 51/002; B65D 75/5883; B41J 2/17523
(Continued)

(56) References Cited

U.S. PATENT DOCUMENTS 2,906,423 A 9/1959 Sandhage
3,695,478 A 10/1972 Sie et al.
(Continued)

FOREIGN PATENT DOCUMENTS

CN 2808558 Y * 8/2006
JP 7-33178 2/1995
(Continued)

OTHER PUBLICATIONS

Chinese Office Action dated Feb. 27, 2015 in corresponding Chinese Patent Application No. 201280063349.9.
(Continued)

*Primary Examiner* — James N Smalley

(57) ABSTRACT

A plug in accordance with one aspect of the present invention is a plug for a container for containing a liquid, the plug comprising a plug body, a lid adapted to engage the plug body, and a columnar elastic body contained in the plug body and pierceable with an extraction needle; the plug body having an elastic body storage part for storing the elastic body, a liquid guide path communicating with the elastic body storage part, a plurality of axially extending longitudinal ribs formed on an inner wall surface facing the elastic body storage part, and axially extending groove parts formed between the plurality of longitudinal ribs, while a circle passing vertexes of the plurality of longitudinal ribs has a diameter smaller than that of the elastic body.

10 Claims, 14 Drawing Sheets

(51) Int. Cl.

| | |
|---|---|
| ***B65D 75/58*** | (2006.01) |
| ***B65D 51/00*** | (2006.01) |
| ***B41J 2/175*** | (2006.01) |
| *A61J 1/10* | (2006.01) |
| *A61J 1/14* | (2006.01) |

(52) U.S. Cl.
CPC ..... *B65D 75/5883* (2013.01); *A61J 1/10* (2013.01); *A61J 1/1406* (2013.01); *A61J 1/1475* (2013.01)

(58) Field of Classification Search
USPC ..... 215/247, 249; 604/415
See application file for complete search history.

(56) References Cited

U.S. PATENT DOCUMENTS

| | | | | |
|---|---|---|---|---|
| 4,011,961 | A * | 3/1977 | Widen et al. | 215/232 |
| 4,664,274 | A * | 5/1987 | Konrad | 215/232 |
| 4,967,919 | A * | 11/1990 | Earhart | 215/247 |
| 5,088,995 | A | 2/1992 | Packard et al. | |
| 5,199,948 | A | 4/1993 | McPhee | |
| 5,494,170 | A * | 2/1996 | Burns | 215/247 |
| 2003/0231988 | A1* | 12/2003 | Chiarin B01L | 3/50825 422/568 |
| 2004/0178106 | A1 | 9/2004 | Morita | |
| 2007/0060902 | A1* | 3/2007 | Brandenburger et al. | 604/403 |
| 2008/0009783 | A1* | 1/2008 | Branderburger et al. | 604/30 |
| 2008/0072690 | A1* | 3/2008 | Kacian et al. | 73/864.01 |

FOREIGN PATENT DOCUMENTS

| | | |
|---|---|---|
| JP | 7-194671 | 8/1995 |
| JP | 2706632 | 1/1998 |
| JP | 2002-326644 | 11/2002 |
| JP | 2003-169840 | 6/2003 |
| JP | 2004-65459 | 3/2004 |
| JP | 2004-268522 | 9/2004 |
| JP | 2005-27877 | 2/2005 |
| JP | 2006-341914 | 12/2006 |
| JP | 2009-137641 | 6/2009 |
| TW | 201130715 A1 | 9/2011 |

OTHER PUBLICATIONS

International Search Report mailed Apr. 2, 2013 in corresponding International Patent Application No. PCT/JP2012/082811.

Extended European Search Report dated Sep. 24, 2015 in corresponding European Patent Application No. 12860996.3.

Taiwanese Office Action dated Apr. 26, 2016 in corresponding Taiwanese Patent Application No. 101148889.

PCT International Preliminary Report on Patentability mailed Jul. 3, 2014 in corresponding International Patent Application No. PCT/JP2012/082811.

Japanese Office Action dated Jan. 24, 2017 in corresponding Japanese Patent Application No. 2013-550291.

* cited by examiner (a)

(b)

(a)

(b)

(a)

(b)

(a)

(b)

(a)

(b)

PLUG

CROSS-REFERENCE TO RELATED APPLICATIONS

This application is a U.S. national stage application of PCT/JP2012/082811 filed Dec. 18, 2012 and claims foreign priority benefit of Japanese Application No. 2011-281428 filed Dec. 22, 2011 in the Japanese Intellectual Property Office, the contents of which are incorporated herein by reference.

TECHNICAL FIELD

The present invention relates to a plug for liquid containers into which a hollow needle for taking out is stuck so as to extract and use a liquid therefrom, examples of which include ink cartridges for use in printing devices such as printers and transfusion containers for medical use.

BACKGROUND ART

Liquid containers from which liquids are extracted through a hollow needle stuck into a plug using a rubber membrane have been used widely as drip containers for medical use from long ago. In such use, however, the containers are disposable, so that the needle has never been repeatedly stuck in and pulled out. Liquids contained therein have typically been colorless and transparent, thus yielding no big problems even if somewhat leaking therefrom.

For ink cartridges used for printing devices such as printers and the like, there has been a case where a needle for extraction is used while being repeatedly stuck in and pulled out in order to change kinds of ink. Even a small leak of ink will smear thereabout. Hence, there is a need for a plug from which no ink leaks even when a needle is repeatedly stuck in and pulled out.

For solving this problem, there has been a method of press-fitting a rubber plug having a bore greater than that of a plug part into the plug part by using a special device. However, there has been a necessity for a lubricant to be applied at the time of press fitting in addition to a problem of requiring the special device for press fitting. This has led to a problem of complicating a process of cleaning the lubricant.

A spout disclosed in Patent Literature 1 is one for solving the problems mentioned above. In this spout, an elastic body having a slightly smaller outer diameter is inserted into a cylindrical tap, and then a crown part having a protruded pusher pressing the elastic body is brought into contact with the elastic body under pressure, so as to apply a pressure to the elastic body.

In the spout disclosed in Patent Literature 1, it has been necessary for the crown part to be attached such that the protruded pusher projects from the outside of a hole provided in the cylindrical tap to the elastic body on the inside. Therefore, the crown part has not been easy to attach.

A spout disclosed in Patent Literature 2 is one for making it easier for the crown part (crown body) to attach. In this spout, a tap is provided with a taper part for slidably guiding the crown body along the outer periphery of the peripheral wall part of the tap and a slit for allowing the crown body to deform elastically.

In the spout disclosed in Patent Literature 2, as a method of applying a pressure to the elastic body, a protrusion provided at a center part of the crown body is pressed axially, so as to widen the elastic body radially. This allows a pressing force to act from the inner periphery of the tap.

Therefore, when the bore of the spout is small, the pressing force may fail to work sufficiently in the elastic body having a small bore, thus allowing a liquid to leak therefrom and so forth.

A spout disclosed in Patent Literature 3 is one for solving this problem. In this spout, the elastic body enclosed in the tap has a form larger than the inner space of the tap. The inner face of the crown body is formed with a slope tilted with respect to the extracting direction so that the elastic body enclosed in the tap comes into contact therewith under pressure throughout the periphery when the crown body is attached to the tap.

The spout disclosed in Patent Literature 3 has solved the problem of leaking by employing a structure which applies a pressure to the elastic body from the whole periphery.

CITATION LIST

Patent Literature

Patent Literature 1: Japanese Patent Application Laid-Open No. H07-33178

Patent Literature 2: Japanese Patent Publication No. 2706632

Patent Literature 3: Japanese Patent Application Laid-Open No. 2006-341914

SUMMARY OF INVENTION

Technical Problem

Each of the spouts disclosed in Patent Literatures 1 to 3 applies a pressure to an elastic body by forcibly press-fitting a crown body. Since the crown body is press-fitted along an axial direction of the body of the plug, it is inevitable for the elastic body to be compressed axially no matter how contrived.

The axially compressed elastic body unnecessarily enhances the resistance to a needle stuck axially in the same direction, thereby making it hard to stick the needle for the first time.

There is a further problem that a so-called liquid splash occurs, i.e., a liquid having entered a hole formed by a needle jumps out so as to follow the needle pulled out therefrom after having once been stuck therein. This tendency is strong in particular in the spout disclosed in Patent Literature 3, since the elastic body is evenly compressed from all the directions.

It is an object of the present invention to provide a plug which allows a needle to be inserted easily therein and can prevent the liquid splash phenomenon from occurring when pulling out the needle.

Solution to Problem

The plug in accordance with one aspect of the present invention is a plug for a container for containing a liquid, the plug comprising a plug body, a lid adapted to engage the plug body, and a columnar elastic body contained in the plug body and pierceable with an extraction needle; the plug body having an elastic body storage part for storing the elastic body, a liquid guide path communicating with the elastic body storage part, a plurality of axially extending longitudinal ribs formed on an inner wall surface facing the elastic body storage part, and axially extending groove parts formed between the plurality of longitudinal ribs, while a circle passing vertexes of the plurality of longitudinal ribs has a diameter smaller than that of the elastic body.

In this plug, the elastic body serving as a sealing member for the plug has a columnar form. The inner wall surface of the plug body facing the elastic body storage part for storing the elastic body is formed with a plurality of axially extending longitudinal ribs. Axially extending groove parts are formed between the plurality of longitudinal ribs. This makes it easier to insert but harder to compress the elastic body axially. As a result, the needle can easily be inserted into the elastic body. The circle passing the vertexes of the plurality of longitudinal ribs has a diameter smaller than that of the columnar elastic body. Therefore, appropriate compression stresses are applied to the elastic body in directions orthogonal to the axial direction. This prevents the liquid splash phenomenon from occurring when the needle is pulled out.

Each of the plurality of longitudinal ribs may project radially from the inner wall surface by an axially fixed length.

In this case, compression stresses applied to the elastic body in directions orthogonal to the axial direction are substantially constant in the axial direction. Therefore, the needle receives substantially constant compression stresses from the elastic body even when changing its position. Hence, the needle can smoothly be guided axially without bending.

An axially extending gap may be formed between the elastic body stored in the elastic body storage part and the groove part.

In this case, forming the gap reduces the compression stresses axially applied to the elastic body in a region between the gap and the axis of the elastic body. Hence, the needle can be inserted more smoothly.

The longitudinal rib may have a semicircular form in a cross section perpendicular to the axial direction, while the plug body may have a taper form at an opening of the elastic body storage part.

In this case, the longitudinal rib has a semicircular form in a cross section perpendicular to the axial direction, while the plug body has a taper form at the opening of the elastic body storage part, whereby the elastic body can be inserted easily.

The elastic body may have the diameter greater than that of a cylinder passing the vertexes of the plurality of longitudinal ribs but smaller than that of a cylinder passing a bottom face of the groove parts.

In this case, the columnar elastic body has the diameter greater than that of a cylinder passing the vertexes of the plurality of longitudinal ribs but smaller than that of a cylinder passing the bottom face of the groove parts. Therefore, the elastic body can be inserted into the elastic body storage part more easily, and a pressurizing effect on the elastic body can fully be expected.

The lid may have an elastic body holding part for holding the elastic body and a passage part for the needle to pass therethrough, which is formed at a center portion of the elastic body holding part, while the passage part may be provided with a protection plate pierceable with the needle.

In this case, the passage part of the lid is provided with the protection plate, whereby dust and the like can be prevented from adhering to the elastic body. This also proves that the container is unused.

A sealing plate may be provided between the elastic body storage part and the liquid guide path.

In this case, the sealing plate is provided between the elastic body storage part of the plug body and the liquid guide path, so that the elastic body and the liquid contained in the container are prevented from coming into contact with each other for a long period during the storage of the container, whereby both of the elastic body and the liquid are kept from changing their properties.

The plug body may have a welding part for welding a container body.

In this case, the plug body has the welding part for welding the container body, whereby a bag-shaped container can be chosen as the container body, thus developing various uses.

The elastic body may have a head part with a collar having a shoulder with a chamfered corner.

In this case, the columnar elastic body has a collar in its head part, while the collar has a shoulder with a chamfered corner, whereby the elastic body can easily be inserted in the plug body. Further, the lid can easily be mounted to the plug body. It also prevents the liquid from leaking.

The lid may have, on an inner face in a lower end part thereof, an engagement protrusion adapted to engage an engagement groove provided in the plug body.

In this case, the lid is constructed such that the inner face in its lower end part has an engagement protrusion adapted to engage an engagement groove provided in the plug body. Therefore, a simple operation of just press-fitting the lid into the plug body from thereabove can assemble the plug in its assembling process.

Advantageous Effects of Invention

The plug in accordance with one aspect of the present invention allows a needle to be inserted easily therein and can prevent the liquid splash phenomenon from occurring when pulling out the needle.

DESCRIPTION OF EMBODIMENTS

Figure 1:
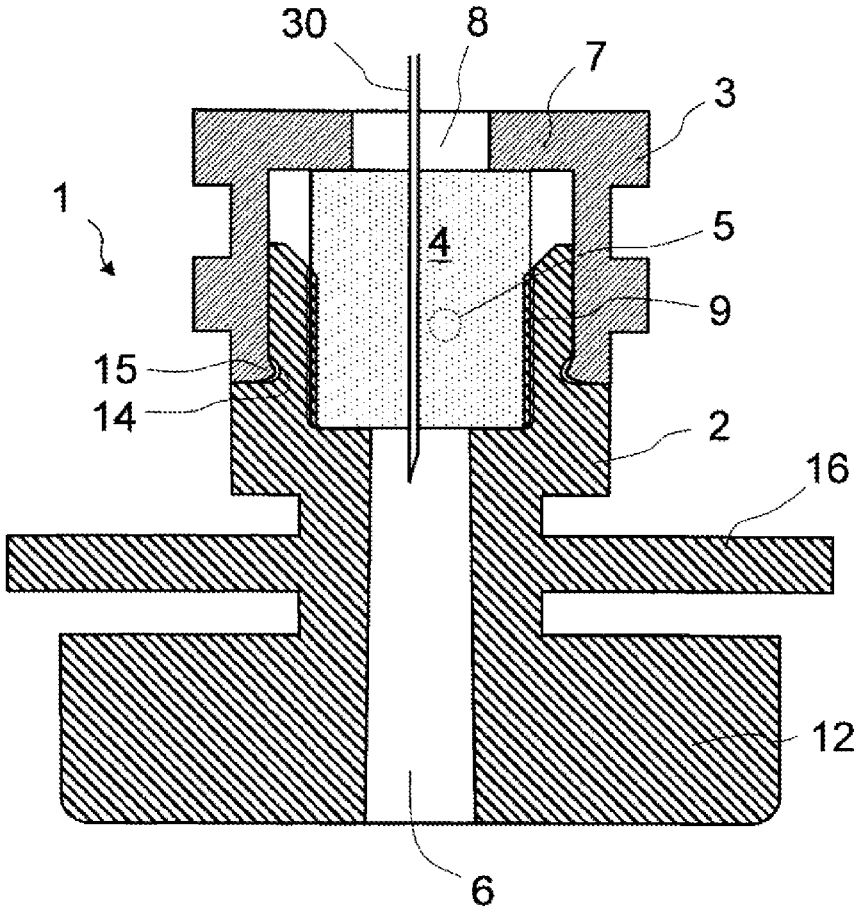
FIG. 1 is a sectional view illustrating a basic embodiment of the plug in accordance with the present invention.
Figure 2:
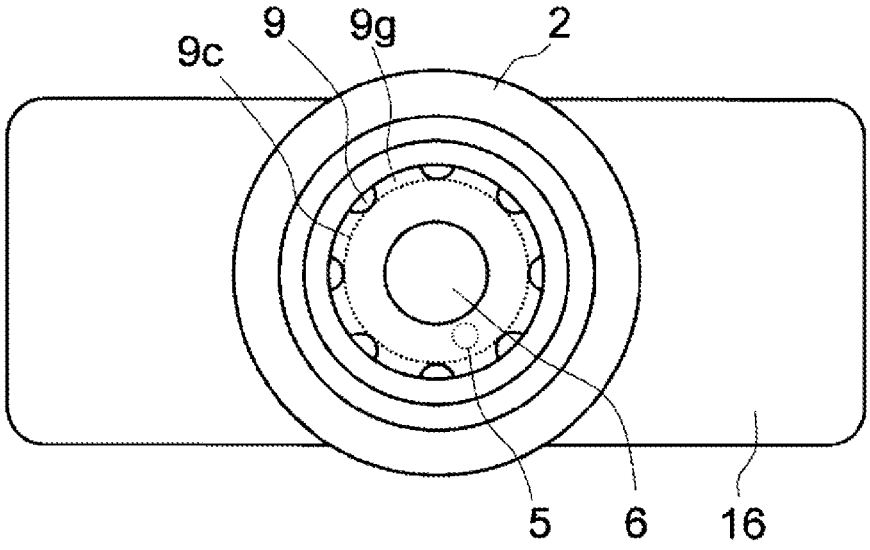
FIG. 2 is a plan view illustrating a plug body of the plug depicted in FIG. 1.
Figure 3:
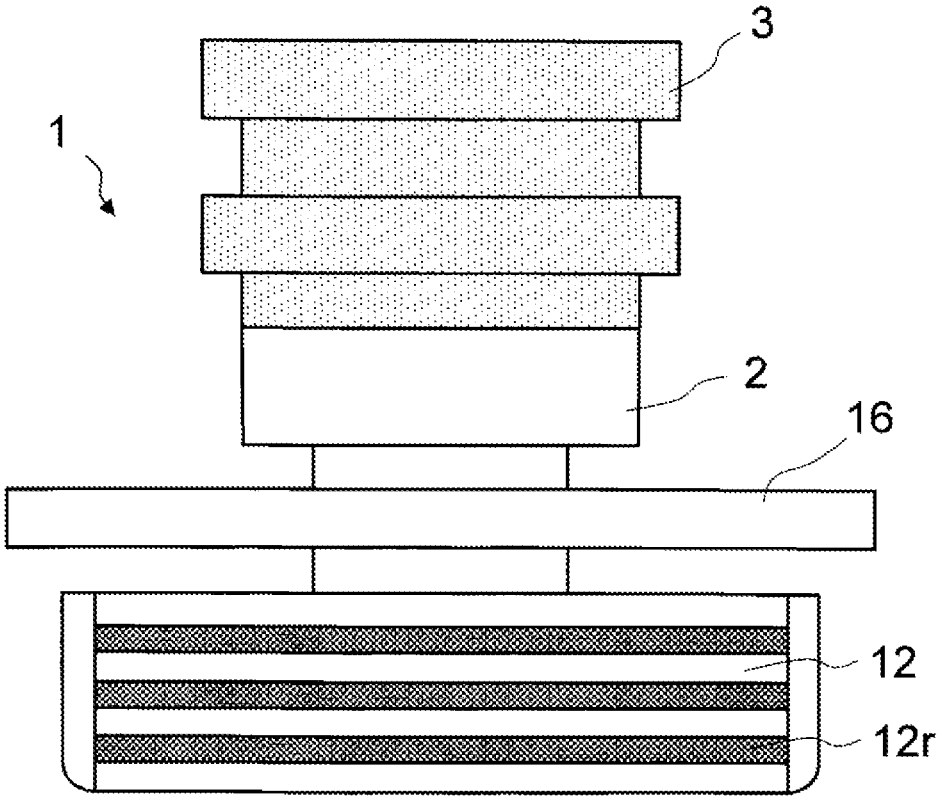
FIG. 3 is a front view illustrating the plug depicted in FIG. 1.
Figure 4:
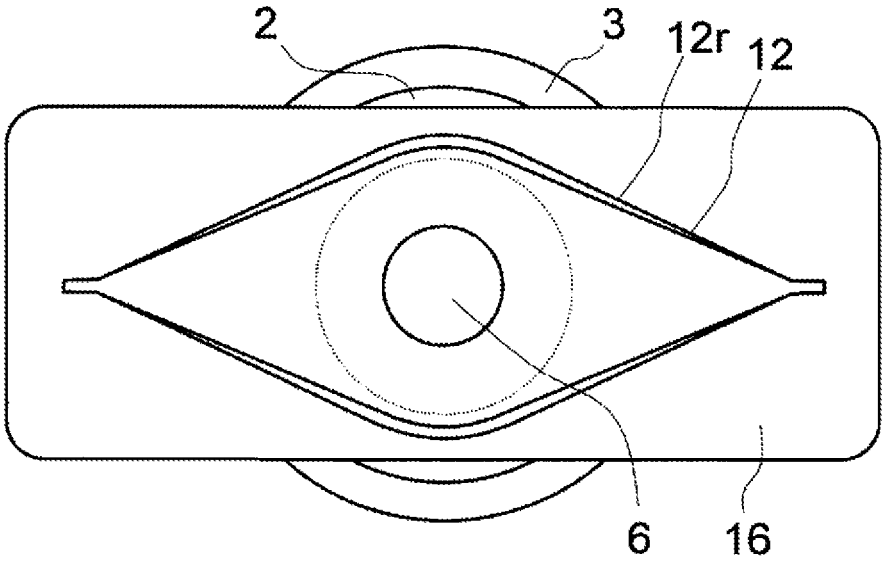
FIG. 4 is a bottom view illustrating the plug depicted in FIG. 1.
Figure 8:
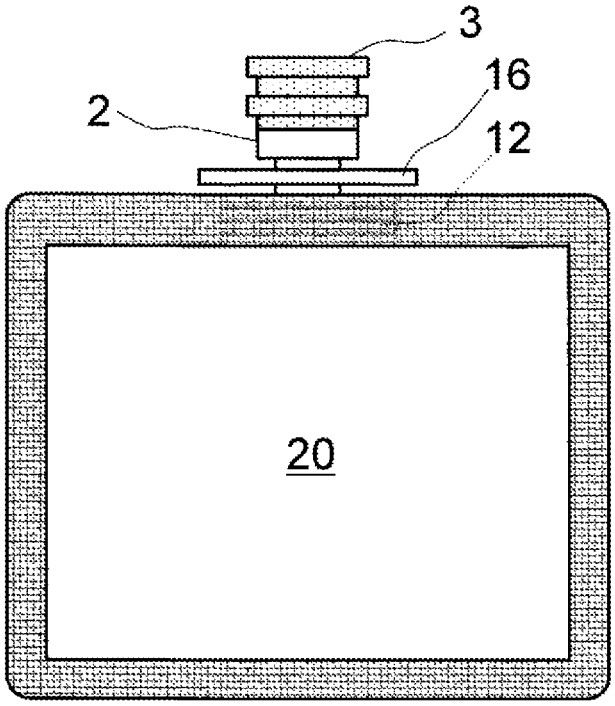
FIG. 8 is a schematic view illustrating a state where the plug depicted in FIG. 1 is attached to a container body.

In the following, preferred embodiments of the plug in accordance with the present invention will be explained in detail with reference to the drawings. FIG. 1 is a sectional view illustrating a basic embodiment of a plug 1 in accordance with the present invention. FIG. 2 is a plan view illustrating a plug body 2 of the plug depicted in FIG. 1. FIG. 3 is a front view illustrating the plug depicted in FIG. 1. FIG. 4 is a bottom view illustrating the plug depicted in FIG. 1. FIG. 8 is a schematic view illustrating a state where the plug depicted in FIG. 1 is attached to a container body shaped into a bag (pouch). With reference to these drawings, the following explanation will be provided.

The plug 1 is a plug for a container for storing a liquid and has the plug body 2, a lid 3 adapted to engage the plug body, and a columnar elastic body 4 contained in the plug body and pierceable with an extraction needle 30.

The plug body 2 has an elastic body storage part 5 which is a space for storing the elastic body 4 and a liquid guide path 6 communicating with the elastic body storage part. The lid 3 has an elastic body holding part 7 for holding the elastic body 4 and a passage part 8, formed at a center portion of the elastic body holding part, for the extraction needle 30 to pass therethrough.

The inner wall surface of the plug body 2 facing the elastic body storage part 5 is formed with a plurality of axially extending longitudinal ribs 9. By "axial" is meant the axial direction of the elastic body storage part 5 or elastic body 4. A plurality of axially extending groove parts 9*g* are formed between the plurality of longitudinal ribs 9. Each longitudinal rib 9 is parallel to the axial direction. In the embodiment illustrated in FIG. 1, the inner wall surface of the plug body 2 is provided with eight longitudinal ribs 9 and eight groove parts 9*g* formed therebetween.

The plurality of longitudinal ribs 9 are formed at circumferentially equal intervals. Each longitudinal rib 9 has a semicircular form in a cross section perpendicular to the axial direction. Each longitudinal rib 9 may have other forms in the cross section perpendicular to the axial direction. Each longitudinal rib 9 may have a trapezoidal form in the cross section perpendicular to the axial direction, for example. The plug body 2 has a taper form at the opening of the elastic storage part 5. The longitudinal ribs 9 have the same form. The longitudinal ribs 9 radially project from the inner wall surface by the same length (i.e., projection width). Each longitudinal rib 9 radially projects from the inner wall surface by an axially fixed length (i.e., projection width).

A cylinder 9*c* passing vertexes of the plurality of longitudinal ribs 9 has a diameter smaller than that of the columnar elastic body 4. The plurality of longitudinal ribs 9 constructed as explained in the foregoing impart straightness to the needle 30 when it is stuck into the elastic body 4.

The elastic body 4 is basically a cylindrical column but may be a polygonal column which can exhibit effects similar to those of the cylindrical column. The elastic body 4 is stored in the elastic body storage part 5 provided in the plug body 2. For easier insertion into the elastic body storage part 5, it is preferred for the elastic body 4 to round its lower end part (see FIG. 7(*a*)). The elastic body 4 has a diameter greater than that of the cylinder 9*c* passing the vertexes of the plurality of longitudinal ribs 9.

The diameter of the elastic body 4 is greater than that of the cylinder 9*c* passing the vertexes of the plurality of longitudinal ribs 9 but smaller than that of a cylinder passing the bottom face of the groove parts 9*g*. This makes it easier to insert the elastic body 4 into the elastic body storage part 5 of the plug body 2.

The elastic body 4 is inserted downward from the upper part of the elastic body storage part 5 of the plug body 2. At the beginning of insertion, the elastic body 4 has a diameter equal to or slightly greater than that of the inner diameter of the elastic body storage part 5 and thus can easily be inserted therein.

After the leading end part of the elastic body 4 comes into contact with the longitudinal ribs 9 provided on the inner wall surface of the plug body 2, the elastic body 4 is pushed in at once, so as to complete its insertion. For inserting the elastic body 4, the lid 3 covering the elastic body 4 from the upper side thereof and the elastic body 4 may be mounted to the plug body 2 at the same time.

Silicone rubber, ethylene propylene rubber, styrene-based elastomers, polyester-based elastomers, and the like are used typically but not exclusively as materials for the elastic body 4.

While high-density polyethylene resins (HDPE), low-density polyethylene resins (LDPE), linear low-density polyethylene resins (L-LDPE), and the like are typically used as materials for the plug body 2 and lid 3, other materials such as polypropylene resins (PP), polyester-based resins, vinyl chloride resins, and ABS resins are selected appropriately according to properties of the liquid to be contained.

The lid 3 will now be explained. The lid 3 functions to hold the elastic body 4 so as to keep it from dropping out. The lid 3 has the elastic body holding part 7 for holding the elastic body 4 and the passage part 8, formed at the center portion of the elastic body holding part, for the extraction needle 30 to pass therethrough.

In the embodiment illustrated in FIG. 1, the passage part 8 is a through hole formed at the center portion of the lid 3. When it is undesirable for the elastic body 4 to be exposed to the outside, the passage part may be formed like a thin plate or membrane instead of the through hole. A separate protective component such as a circularly cut aluminum foil, for example, may be mounted on the elastic body 4.

A method of attaching the lid 3 to the plug body 2 is not limited in particular. In the embodiment illustrated in FIG. 1, an engagement protrusion 15 provided on the inner face in the lower end part of the lid 3 engages an engagement groove 14 provided in the plug body 2, so as to be secured. The engagement protrusion 15 is shaped into a ring continuous all over the periphery but is not required to be so. It may comprise nail-like structures provided at several locations on the circumference or a pair of threads in threadable engagement with each other provided on the inner periphery of the lid 3 and the outer periphery of a neck part of the plug body 2, respectively. The lid 3 attached to the plug body 2 is brought into contact with the plug body 2 under pressure. The lid 3 is not brought into contact with the elastic body 4 under pressure. This makes it hard for axial compression stresses to be applied to the elastic body 4.

Figure 10:
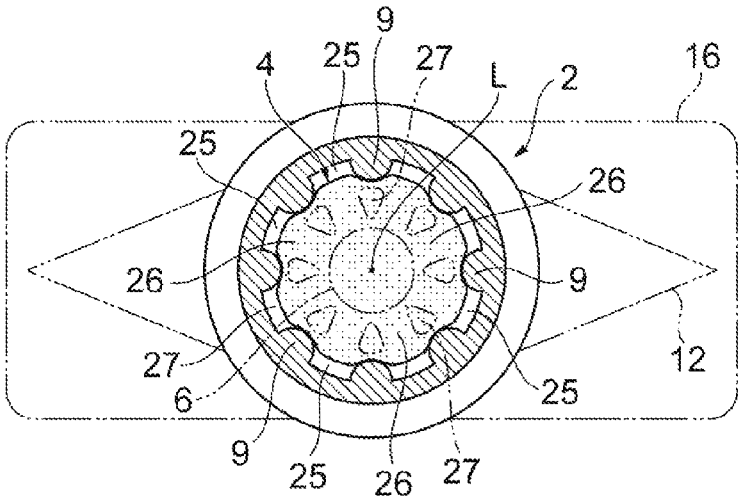
FIG. 10(*a*) is a sectional view taken along the line XA-XA of FIG. 10(*b*), while FIG. 10(*b*) is a longitudinal sectional view illustrating a compressed part in the plug depicted in FIG. 1.
Figure 10:
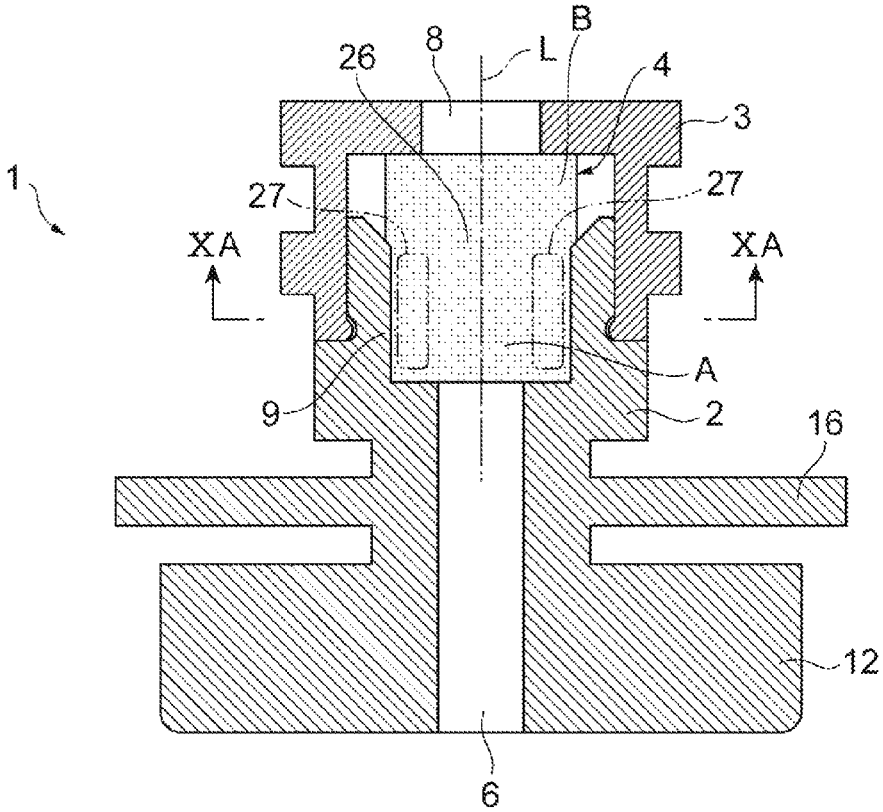

A state where the elastic body 4 is contained in the plug body 2 will now be explained with reference to FIG. 10.

The elastic body 4 has a columnar form before being inserted into the elastic body storage part 5. Since the cylinder 9*c* passing the vertexes of the plurality of longitudinal ribs 9 has a diameter smaller than that of the elastic body 4, a part of the outer periphery of the elastic body 4 comes into contact with the longitudinal ribs 9, so as to be constricted (see FIG. 10(*a*)), after the elastic body 4 is inserted into the elastic body storage unit 5. In other words, the elastic body 4 is pressurized by the surfaces of the axially extending longitudinal ribs 9.

A plurality of gaps 25 are formed between the elastic body 4 stored in the elastic body storage part 5 and the groove parts 9*g*. Each gap 25 extends axially. The elastic body 4 may come into close contact with the longitudinal ribs 9 and groove parts 9*g*, so as not to form the gaps 25. The elastic body 4 may come into close contact with a portion of the groove parts 9*g* while being separated from the other parts of the longitudinal ribs 9, so as to form small gaps.

The elastic body 4 is compressed horizontally (i.e., in directions orthogonal to the axial direction) in the constricted part thereof. Therefore, uncompressed and compressed parts 26, 27 are formed in the elastic body 4 so as to be arranged alternately on the circumference of the same circle. In this case, the center of the circle substantially coincides with a center axis L of the elastic body storage part 5. The uncompressed part 26 is a part where the compression stress is smaller than a predetermined stress. The compressed part 27 is a part where the compression stress is greater than the predetermined stress.

A plurality of compressed parts 27 are formed in a lower region (region on the liquid guide path 6 side) A of the elastic body 4 surrounded by the plurality of longitudinal ribs 9. The plurality of compressed parts 27 are formed at circumferentially equal intervals. The compressed parts 27 are formed between the respective longitudinal ribs 9 and the center axis L of the elastic body storage part 5. The radial length of the region formed with the compressed parts 27 is about ⅓ to ½ of the radius of the elastic body 4.

As mentioned above, each groove part 9*g* projects radially from the inner wall surface by an axially fixed length. Hence, as illustrated in FIG. 10(*b*), the radial length (width) of the compressed parts 27 is axially constant. In other words, they have the same cross-sectional structure in axial cross sections in the lower region A of the elastic body 4.

A plurality of uncompressed parts 26 are formed between the plurality of compressed parts 27 in the lower region A of the elastic body 4 surrounded by the plurality of longitudinal ribs 9. The uncompressed parts 26 are formed between the respective groove parts 9*g* and the center axis L of the elastic body storage part 5 in the region A. Since the gaps 25 are formed between the elastic body 4 and the groove parts 9*g*, compression stresses are reduced in directions orthogonal to the axial direction in the uncompressed parts 26. A region (region on the passage part 8 side) B above the longitudinal ribs 9 in the elastic body 4 is the uncompressed part 26. In other words, the region other than the compressed parts 27 in the elastic body 4 is the uncompressed part 26.

A mode in which the plug 1 constructed as in the foregoing is used will be explained. As illustrated in FIGS. 1, 3, and 8, the plug 1 has a welding part 12. The welding part 12 is a part for attaching the plug body 2 to a container body 20. In this embodiment, the welding part 12 is shaped like a diamond in a planar view. The plug body is securely attached to the container body 20 by welding such that the opening of the bag-shaped container body 20 holds the diamond in the shorter diameter direction.

After the plug 1 is welded to the container body 20, a liquid D to be contained is fed through the passage part 8 to the container body 20 whose periphery is sealed.

As illustrated in FIG. 3, the welding part 12 of the plug body 2 is provided with three welding ribs 12*r*. The welding ribs 12*r* slightly project like lateral streaks from the surface of the welding part 12 and act to prevent the pressure from dispersing when welding the container body 20, so that the welding proceeds securely.

According to the material and structure of the container body 20, various modes are selected for attaching the plug body 2 to the container body 20. For example, though not depicted in particular, the lower face of the plug body may be formed with a disk-shaped flange, which is welded to a circular hole opened in the bag-shaped container body.

When the container body is a rigid bottle, the container body and the plug body may be brought into threadable contact with each other by threads or attached to each other as engagement structures by capping.

Figure 9:
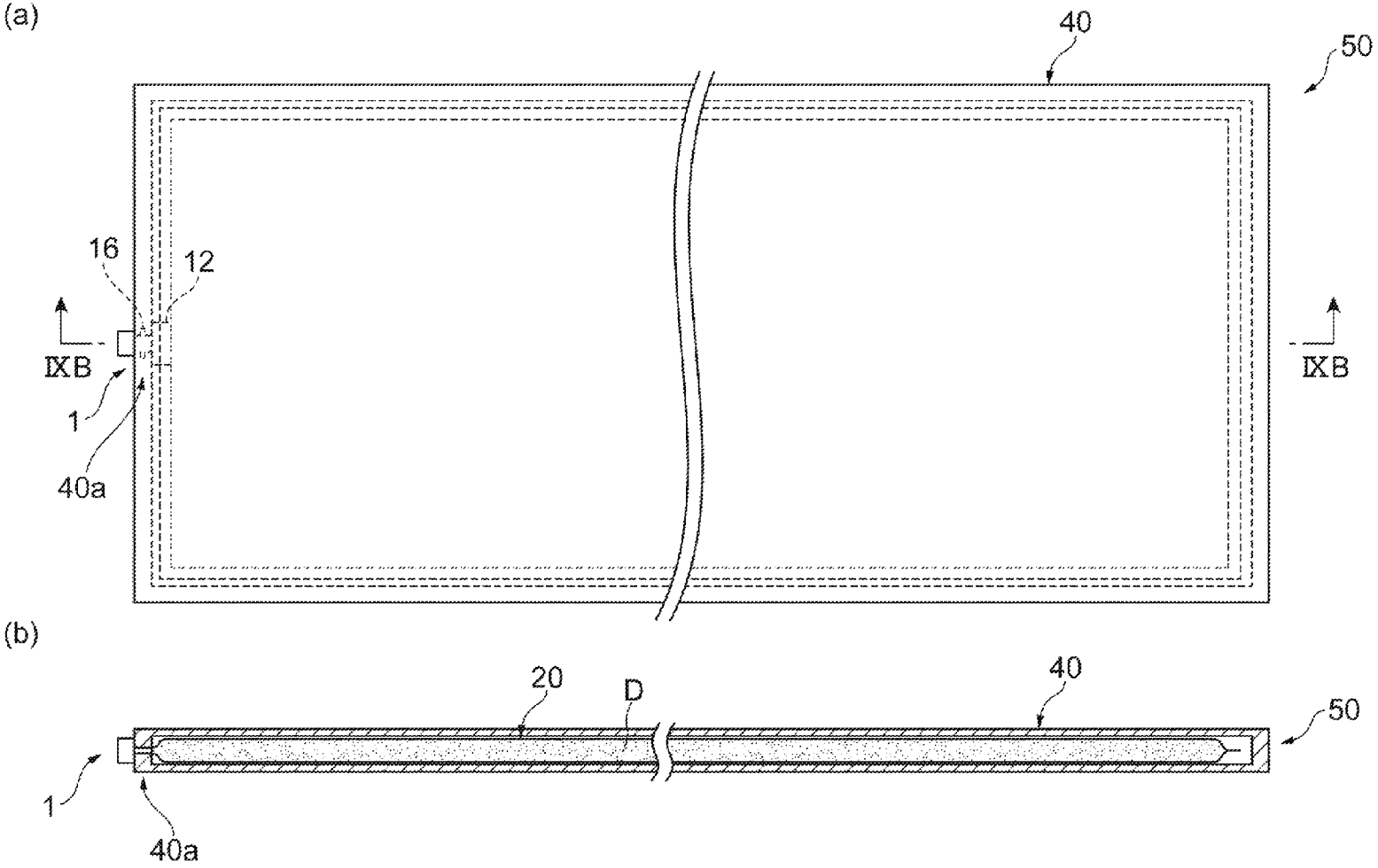
FIG. 9(*a*) is a plan view illustrating a state where the container body depicted in FIG. 8 is stored in a cartridge, while FIG. 9(*b*) is a sectional view taken along the line IXB-IXB of FIG. 9(*a*)

A flange 16 illustrated in FIGS. 1 to 6 is one for accurately attaching the container body 20 into a case 40 made of a resin. As illustrated in FIG. 9, the container body 20 having the plug 1 attached thereto is stored in the case 40 having an elongated form. The flange 16 of the plug 1 engages one end part 40*a* of the case 40, whereby the container body 20 is mounted to the case 40, thus completing a cartridge 50. The lid 3 and plug body 2 of the plug 1 partly project from one end of the cartridge 50.

Figure 11:
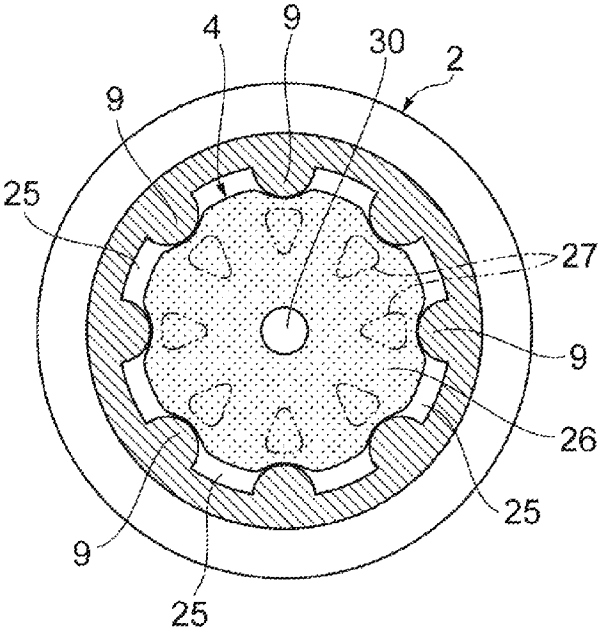
FIG. 11(*a*) is a sectional view taken along the line XIA-XIA of FIG. 11(*b*), while FIG. 11(*b*) is a longitudinal sectional view illustrating a state where a needle is inserted in the plug depicted in FIG. 1.
Figure 11:
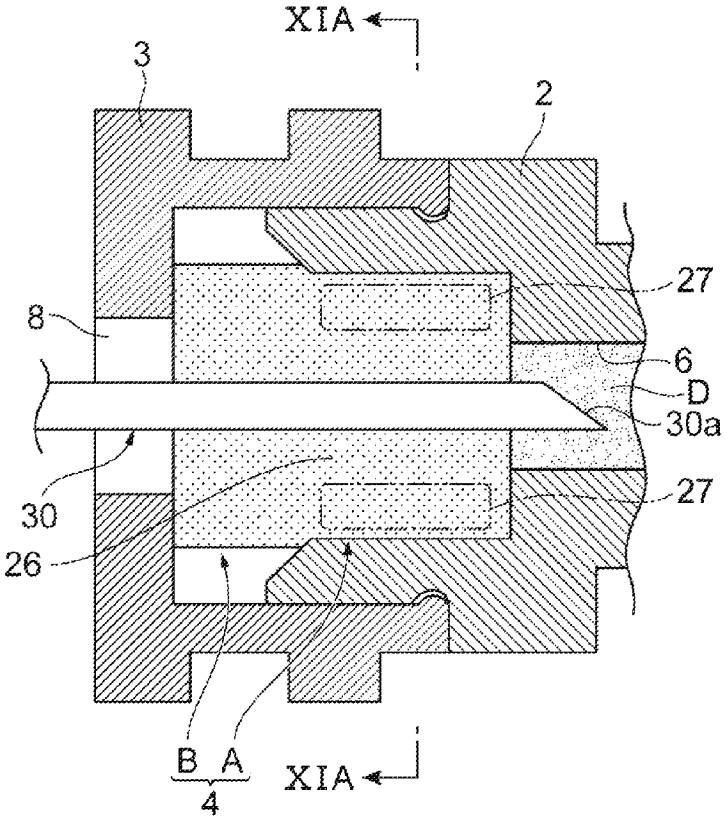

A state where the needle 30 is inserted into the plug 1 will now be explained with reference to FIG. 11. The cartridge 50 is inserted at a predetermined position of a printing device such as a printer. The direction in which the cartridge 50 is inserted varies among printers and the like. For example, the cartridge 50 is inserted horizontally. When the cartridge 50 is inserted at the predetermined position, the needle 30 fixed within the printer and the like passes through the passage part 8, so as to stick in the elastic body 4.

When piercing the elastic body 4, the needle 30 at first sticks in the uncompressed part 26 formed in the region B. This makes the needle 30 easy to stick. When the leading end of the needle 30 reaches the region A surrounded by the longitudinal ribs 9, the needle 30 advances through the uncompressed part 26 formed between the plurality of compressed parts 27. Moderate compression stresses act on the uncompressed part 26 in directions orthogonal to the axial direction. Therefore, the needle 30 advances stably. Since the longitudinal ribs 9 apply uniform compressive forces to the compressed parts 27, the compression stresses in the uncompressed part 26 are circumferentially uniform. Since the compression stresses are the lowest at the center axis L, the needle 30 is guided to the center (center axis L). As a consequence, the needle 30 is guided so as to approach its normal position. Even when stuck in a region near the compressed part 27 or within the compressed part 27, the needle 30 is not hindered from advancing axially, since the compressed part 27 is a region compressed in directions orthogonal to the axial direction.

Thus, compression stresses are applied to the elastic body 4 hardly in the axial direction but in directions orthogonal to the axial direction. In other words, the elastic body 4 is compressed not in the axial direction but in directions orthogonal to the axial direction. The elastic body 4 is compressed and held in directions orthogonal to the axial direction by the plug body 2. This reduces the resistance to the needle 30 being inserted. As a result, the needle 30 can easily be inserted in a stable state (i.e., the state keeping straightness) as illustrated in FIGS. 11(*a*) and 11(*b*). The needle 30 is also hard to bend in the process of being inserted. A leading end 30*a* of the needle 30 having penetrated through the elastic body 4 comes into contact with the liquid D.

Behaviors of the needle 30 at the time of being pulled out after use will now be explained. In the conventional scheme of applying pressures to the elastic body from all over the periphery, the liquid splash phenomenon has occurred such that the liquid jumps out so as to follow the needle pulled out. In the case of the plug 1, by contrast, compression stresses are applied to the elastic body only in horizontal directions (i.e., directions orthogonal to the axial direction), whereby no liquid splash phenomenon occurs with the pullout of the needle 30.

Figure 12:
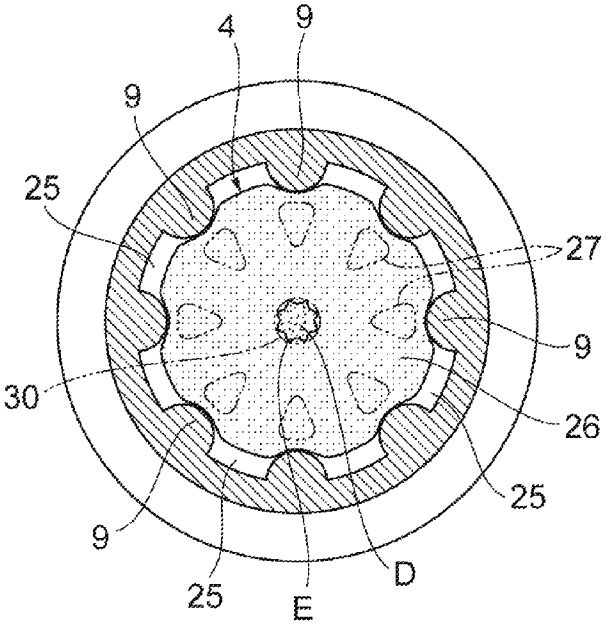
FIG. 12(*a*) is a sectional view taken along the line XIIA-XIIA of FIG. 12(*b*), while FIG. 12(*b*) is a longitudinal sectional view illustrating a state where the needle is pulled a little from the state of FIG. 11(*b*)
Figure 12:
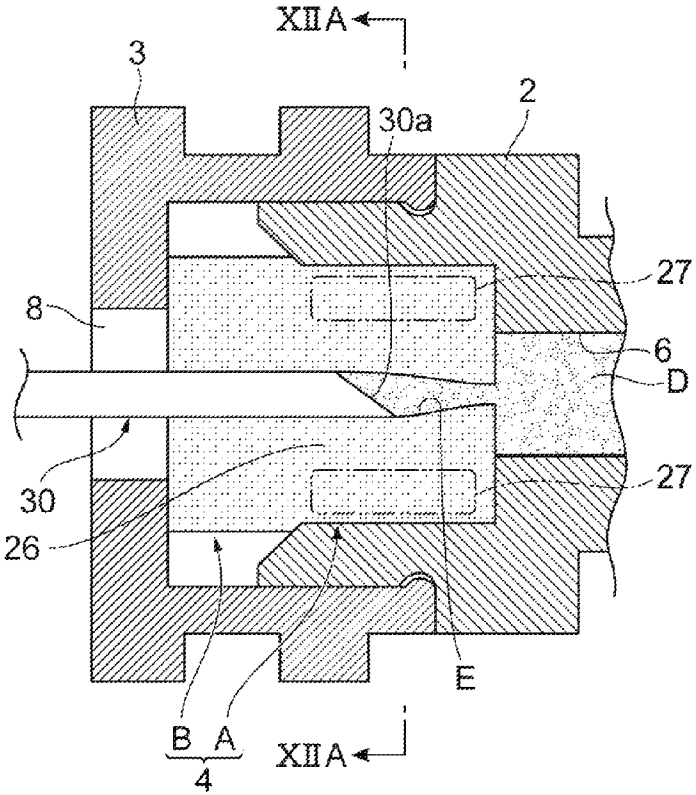
Figure 13:
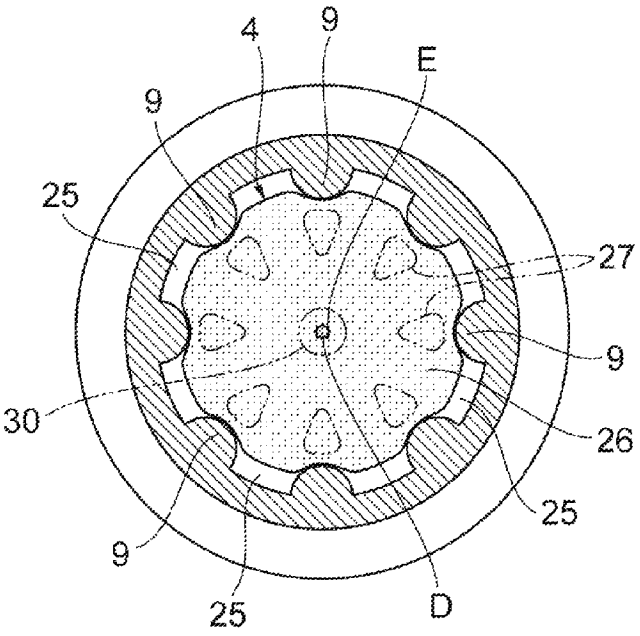
FIG. 13(*a*) is a sectional view taken along the line XIIIA-XIIIA of FIG. 13(*b*), while FIG. 13(*b*) is a longitudinal sectional view illustrating a state where the needle is further pulled from the state of FIG. 12(*b*)
Figure 13:
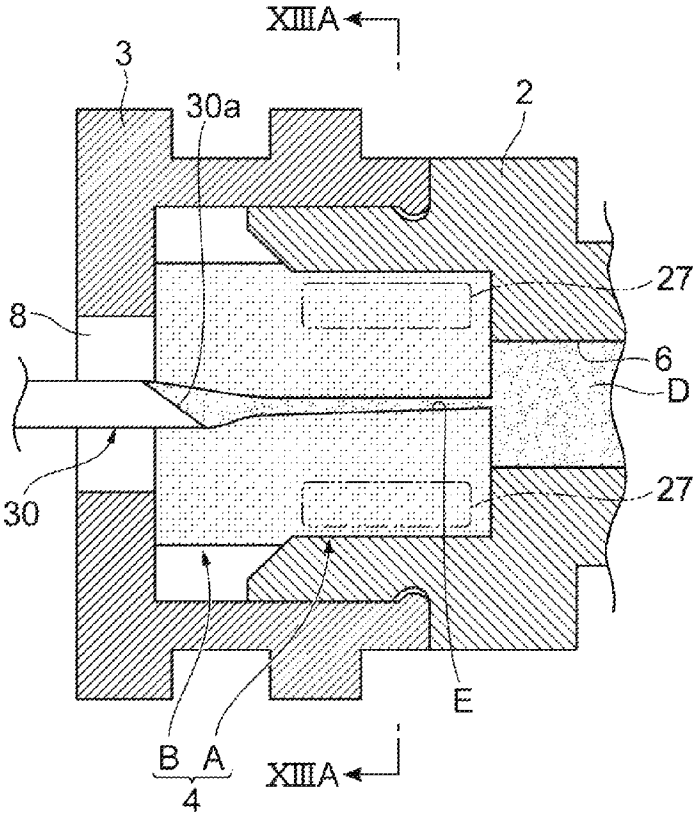

The pullout of the needle 30 will be explained in more detail with reference to FIGS. 12 to 14. First, a case where the needle 30 is pulled a little when the cartridge 50 is taken out of the printer or the like will be explained. As illustrated in FIGS. 12(*a*) and 12(*b*), a needle hole E is formed within the region A after the leading end 30*a* of the needle 30 passed therethrough. The needle hole E gradually closes as the needle 30 is pulled. Parts of the needle hole E facing the compressed parts 27 radially retract into a concave form in response to radial compression stresses. That is, the elastic body 4 projects radially inward. On the other hand, parts of the needle hole E facing the uncompressed parts 26 project radially into a convex form. That is, the elastic body 4 retracts radially outward. Thus, the needle hole E gradually closes while being formed paraboloidal.

That is, the needle hole E is formed as a gap between the parts compressed and uncompressed by the longitudinal ribs 9. This gap provides a structure through which the liquid D is easy to return into the container body 20 (i.e., on the liquid guide path 6 side).

When the needle 30 is pulled more, the needle hole E is further reduced while keeping the paraboloidal form mentioned above as illustrated in FIGS. 13(*a*) and 13(*b*). That is, the needle hole E is formed as a gap between the parts compressed and uncompressed by the longitudinal ribs 9. The gap provides a structure through which the liquid D is easy to return into the container body 20 (i.e., on the liquid guide path 6 side). This paraboloidal structure prevents the needle hole E from closing immediately after the leading end 30*a* of the needle 30 passes therethrough.

Figure 14:
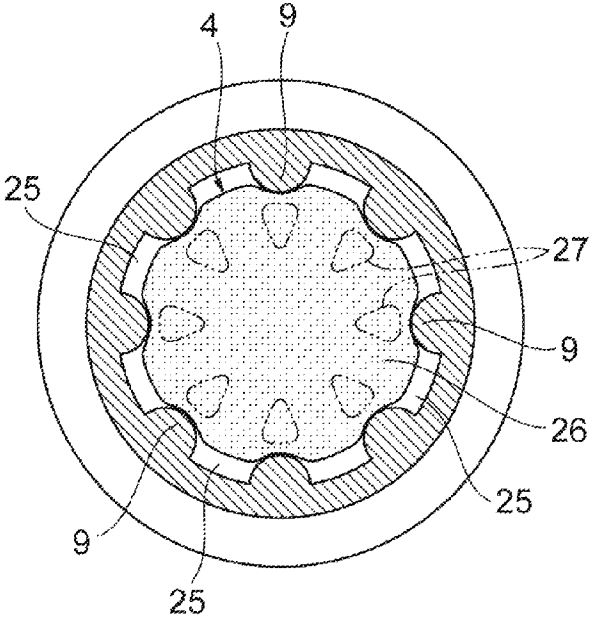
FIG. 14(*a*) is a sectional view taken along the line XIVA-XIVA of FIG. 14(*b*), while FIG. 14(*b*) is a longitudinal sectional view illustrating a state where the needle is pulled out.
Figure 14:
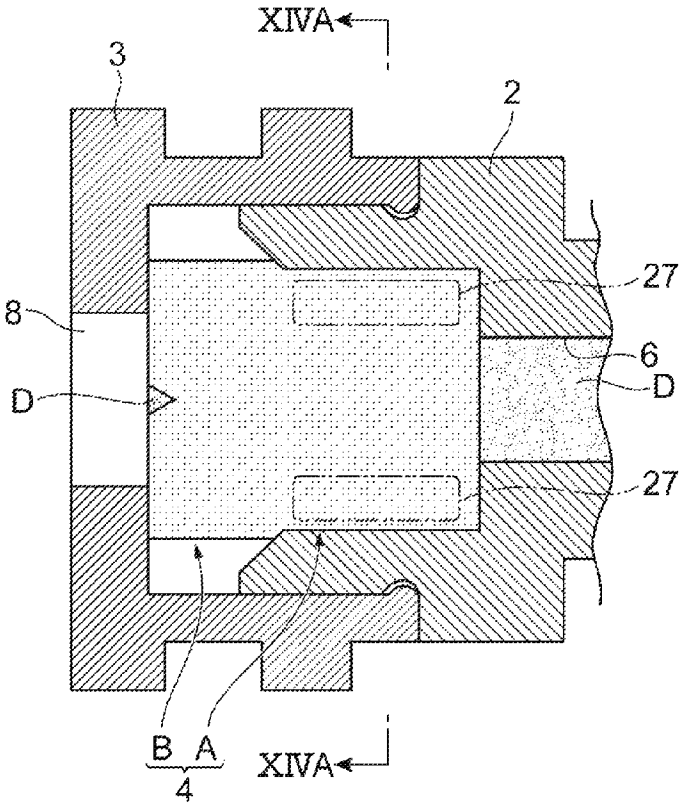

When the needle 30 is pulled out completely, the needle hole E is closed as illustrated in FIG. 14(*a*). In this case, the liquid D remains only by a very small amount at the tap (one end face of the elastic body 4) as illustrated in FIG. 14(*b*). Thus, the plug 1 is constructed such that the liquid D such as ink is hard to remain within the needle 30 or at the tap.

In the plug 1 of the embodiment explained in the foregoing, the inner wall surface of the plug body 2 facing the elastic body storage part 5 is formed with a plurality of axially extending longitudinal ribs 9. The axially extending groove parts 9*g* are formed between the plurality of longitudinal ribs 9. This makes it easier to insert but harder to compress the elastic body 4 axially. As a result, the needle 30 can easily be inserted in the elastic body 4. The diameter of the circle 9*c* passing the vertexes of the plurality of longitudinal ribs 9 is smaller than that of the columnar elastic body 4. Hence, moderate compression stresses are applied to the elastic body 4 in directions orthogonal to the axial direction. This prevents the liquid splash phenomenon from occurring at the time when the needle 30 is pulled out.

A plug provided with a cavity serving as a reservoir within an elastic body has conventionally been known. Forming such a cavity in the elastic body makes it hard to shape the elastic body. In the plug 1 of the above-mentioned embodiment, it is not necessary for the elastic body to be provided with a cavity serving as a reservoir, whereby the elastic body 4 is easy to shape. The needle hole E, which is naturally formed by the needle 30, can be used so that the liquid D flows therethrough to the container body 20. No liquid will leak even when the needle 30 is repeatedly stuck in and pulled out.

The plurality of longitudinal ribs 9 project radially from the inner wall surface by an axially fixed length, whereby compression stresses applied to the elastic body 4 in directions orthogonal to the axial direction are substantially constant in the axial direction. Therefore, the needle 30 receives substantially constant compression stresses from the elastic body even when changing its position. Hence, the needle 30 can smoothly be guided axially without bending.

The axially extending gap 25 is formed between the elastic body 4 and the groove part 9*g*, so as to reduce the compression stress axially applied to the elastic body 4 in a region between the gap 25 and the axis of the elastic body 4, i.e., the uncompressed part 26. Hence, the needle 30 can be inserted more smoothly.

Since the longitudinal rib 9 has a semicircular form in a cross section perpendicular to the axial direction, while the plug body 2 has a taper form at an opening of the elastic body storage part 5, the elastic body 4 can be inserted easily.

When being inserted into the elastic body storage part 5 of the plug body 2, the columnar elastic body 4 has substantially the same diameter at the beginning of insertion and thus is easy to insert. The elastic body 4 can easily be inserted by axial press fitting alone after the leading end of the elastic body 4 comes into contact with the longitudinal ribs 9 on the inner wall surface of the storage part 5, whereby the plug 1 can be assembled simply.

Since the diameter of the columnar elastic body 4 is greater than that of the cylinder 9*c* passing the vertexes of the plurality of longitudinal ribs 9 but smaller than that of a cylinder passing the bottom face of the groove parts 9*g*, the elastic body 4 can be inserted more easily in the elastic body storage part 5. Also, the pressurizing effect on the elastic body 4 can fully be expected.

Since the plug body 2 has the welding part 12 for welding the container body 20, a bag-shaped container can be chosen as the container body 20, thus developing various uses.

Since the lid 3 has, on the inner face in the lower end part thereof, the engagement protrusion 15 adapted to engage the engagement groove 14 provided in the plug body 2, a simple operation of just press-fitting the lid 3 into the plug body 2 from thereabove can assemble the plug 1 in the process of assembling the plug 1.

Figure 5:
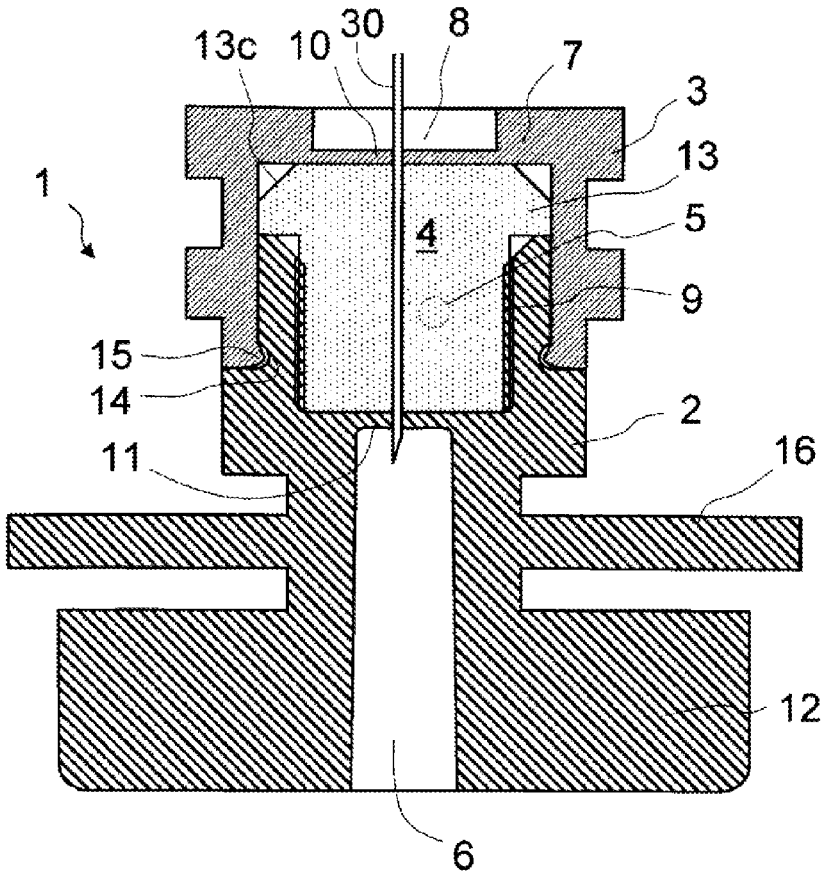
FIG. 5 is a sectional view illustrating another embodiment of the plug in accordance with the present invention.
Figure 6:
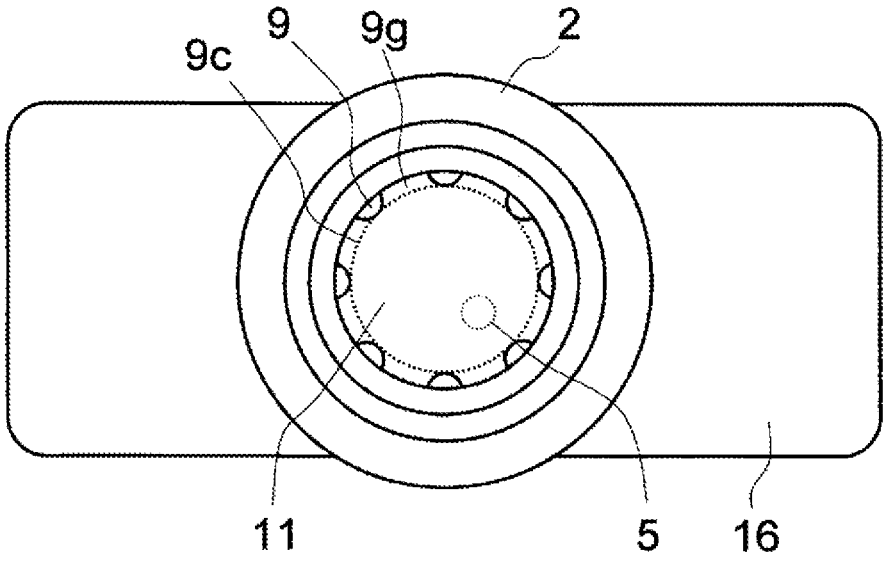
FIG. 6 is a plan view illustrating the plug body of the plug depicted in FIG. 5.
Figure 7:
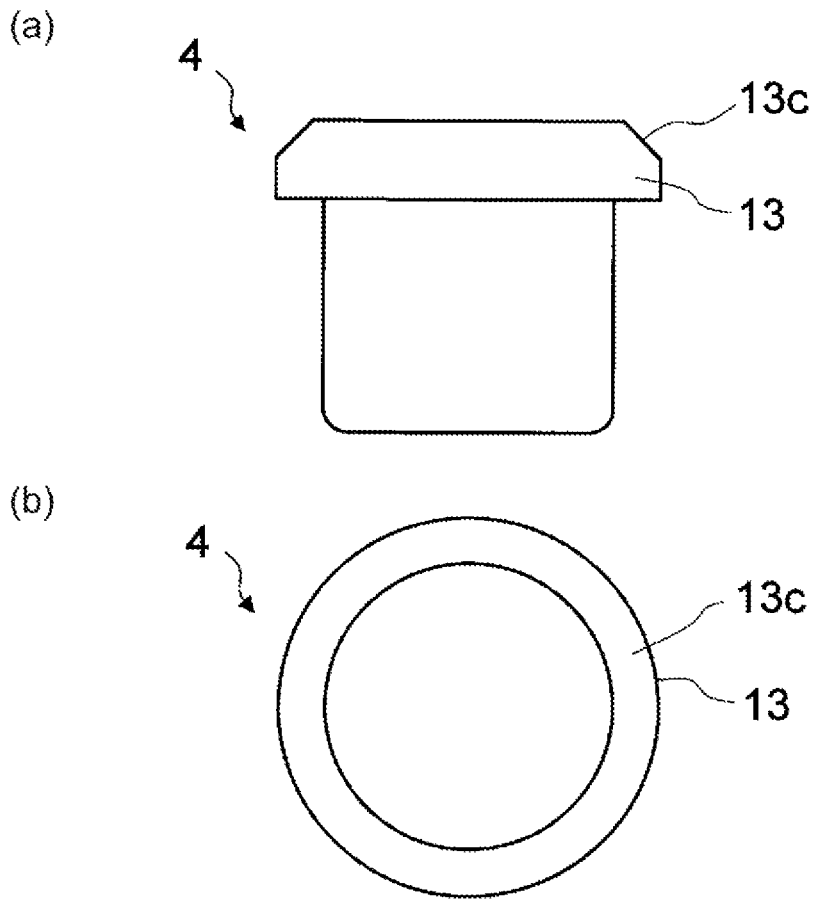
FIGS. 7(*a*) and 7(*b*) are schematic views illustrating an elastic body of the plug depicted in FIG. 5 as seen sideways and from thereabove, respectively.

FIG. 5 is a sectional view illustrating another embodiment of the plug 1 in accordance with the present invention. FIG. 6 is a plan view illustrating the plug body 2 of the plug 1 depicted in FIG. 5 as seen from thereabove. FIGS. 7(*a*) and 7(*b*) are schematic views illustrating the elastic body 4 of the plug 1 depicted in FIG. 5 as seen sideways and from thereabove, respectively.

In the embodiment illustrated in FIG. 5, the columnar elastic body 4 has a collar 13 in its head part. A corner of a shoulder of the collar 13 is formed with a chamfer 13*c*. The passage part 8 of the lid 3 is covered with a thin protection plate 10. A thin sealing plate 11 is provided between the elastic body storage part 5 and liquid guide path 6 of the plug body 2. Except for these points, this embodiment is basically the same as the embodiment illustrated in FIG. 1.

Since the elastic body 4 has the collar 13, which comes into close contact with the upper face of the plug body 2, the sealing performance of the container body 20 becomes higher. While the collar 13 is axially compressed as being held between the upper face of the plug body 2 and the lid 3, the influence thereof fails short of reaching the center part of the elastic body 4 and thus will not adversely affect the sticking and pulling of the extraction needle.

Since the chamfer 13*c* is formed at the corner of the shoulder of the collar 13, the elastic body 4 can easily be inserted in the plug body 2. Further, the lid 3 can easily be mounted to the plug body 2. This also prevents the liquid from leaking.

Since the passage part 8 of the lid 3 is provided with the protection plate 10, the elastic body 4 is not exposed to the outside, which can prevent dust from accumulating on the upper face of the elastic body 4 and so forth. The protection plate 10 is so thin that it does not hinder the extraction needle 30 from piercing. The protection plate 10 remaining intact proves that the package is unopened.

Since the thin sealing plate 11 is provided between the elastic body storage part 5 and liquid guide path 6 of the plug body 2, when the container body 20 is unused, the liquid contained therein and the elastic body 4 can be prevented from coming into direct contact with each other. This can keep the liquid from coming into contact with the elastic body 4 for a long period of time and being adversely affected thereby and the elastic body 4 from deteriorating while in contact with the liquid. The sealing plate 11 is also so thin that it does not hinder the extraction needle 30 from piercing.

Since the liquid D (content) cannot be fed from the plug 1 provided with the sealing plate 11, the periphery of the container body 20 is partly left unsealed in the example illustrated in FIG. 8, so as to feed the liquid D therefrom, and is finally sealed thereafter.

As explained in the foregoing, the plug 1 of the above-mentioned embodiment is easy to assemble because of its simple structure, exhibits favorable basic usability such as easiness for the needle 30 to pierce, and is less likely to leak liquids. It also has an excellent merit that no liquid splash occurs when pulling out the needle 30 and so forth. The plug 1 can favorably be used as a plug for containers for storing various liquids.

The plug of the present invention is not limited to the above-mentioned embodiments. For example, the length by which the plurality of longitudinal ribs 9 project radially from the inner wall surface may vary axially. That is, the longitudinal ribs 9 may have a taper form somewhat tilting axially. The numbers of the longitudinal ribs 9 and groove parts 9*g* are not limited in particular. The number or projection width of the longitudinal ribs 9 may be changed according to the form, material, or size of the elastic body 4 to be held.

INDUSTRIAL APPLICABILITY

The plug in accordance with one aspect of the present invention allows a needle to be inserted easily therein and can prevent the liquid splash phenomenon from occurring when pulling out the needle.

REFERENCE SIGNS LIST

1 plug
2 plug body
3 lid
4 elastic body
5 elastic body storage part
6 liquid guide path
7 elastic body holding part
8 passage part
9 longitudinal rib
9*g* groove part
10 protection plate
11 sealing plate
12 welding part
12*r* welding rib
13 collar
13*c* chamfer
14 engagement groove
15 engagement protrusion
16 flange
20 container body
30 extraction needle

The invention claimed is:

1. A plug for a container for containing a liquid, the plug comprising:

a plug body;

a lid adapted to engage the plug body; and a columnar elastic body contained in the plug body and pierceable with an extraction needle, wherein the plug body has:

a cylindrical storage space in which the columnar elastic body is stored, the cylindrical storage space having a central vertical axis;

a liquid guide path communicating with the cylindrical storage space; and a plurality of longitudinal ribs disposed on an inner wall surface of the cylindrical storage space, elongated in an axial direction along the central vertical axis in parallel, disposed on the inner wall surface at intervals along a circumferential direction around the central vertical axis, and forming grooves extending in the axial direction between neighboring ribs of the plurality of longitudinal ribs, a circle passing through vertices of the plurality of longitudinal ribs has a diameter smaller than that of the elastic body, and the plurality of ribs are compressing the elastic body in radially inward directions orthogonal to the central vertical axis prior to formation of a needle hole through the elastic body along the central vertical axis, such that, upon formation of the needle hole, portions of the elastic body compressed by the plurality of ribs cause the elastic body to close the needle hole.

2. A plug according to claim 1, wherein each of the plurality of longitudinal ribs projects radially inward from the inner wall surface by a fixed length.

3. A plug according to claim 1, wherein the elastic body is in contact with the plurality of longitudinal ribs but is radially spaced from portions of the inner wall surface between the plurality of longitudinal ribs.

4. A plug according to claim 1, wherein each of the plurality of longitudinal ribs has a semicircular form in a cross section perpendicular to the axial direction; and wherein the plug body has a taper form at an opening of the cylindrical storage space.

5. A plug according to claim 1, wherein the elastic body has a diameter smaller than that of the cylindrical storage space defined by bottom faces of the grooves.

6. A plug according to one of claim 1, wherein the lid has an elastic body holding part for holding the elastic body and a passage part for the needle to pass therethrough, the passage part formed at a center portion of the elastic body holding part, and the passage part is provided with a protection plate pierceable with the needle.

7. A plug according to claim 1, wherein a sealing plate is provided between the cylindrical storage space and the liquid guide path.

8. A plug according to claim 1, wherein the plug body has a welding part for welding a container body.

9. A plug according to claim 1, wherein the elastic body has a head part with a collar having a shoulder with a chamfered corner.

10. A plug according to claim 1, wherein the lid has, on an inner face in a lower end part thereof, an engagement protrusion adapted to engage an engagement groove provided in the plug body.

* * * * *